US007374247B2

(12) United States Patent
Welsh et al.

(10) Patent No.: US 7,374,247 B2
(45) Date of Patent: May 20, 2008

(54) FOOTREST FOR CHAIR

(76) Inventors: Kerry L. Welsh, 4455 Torrance Blvd., #139, Torrance, CA (US) 90503; Nigel Miller, 842 19th St., Hermosa Beach, CA (US) 90254

( * ) Notice: Subject to any disclaimer, the term of this patent is extended or adjusted under 35 U.S.C. 154(b) by 0 days.

(21) Appl. No.: 11/297,931

(22) Filed: Dec. 8, 2005

(65) Prior Publication Data

US 2007/0001502 A1 Jan. 4, 2007

Related U.S. Application Data

(60) Provisional application No. 60/697,460, filed on Jul. 8, 2005.

(51) Int. Cl.
*A47C 7/52* (2006.01)

(52) U.S. Cl. ..... 297/423.19; 297/423.27; 297/423.31; 297/423.4

(58) Field of Classification Search ..... 297/30, 297/271.1–271.4, 423.11, 423.12, 423.19, 297/423.27, 423.3, 423.31, 423.35, 423.4
See application file for complete search history.

(56) References Cited

U.S. PATENT DOCUMENTS 280,160 A * 6/1883 Emerson ..... 297/271.2
357,383 A * 2/1887 Hamel ..... 297/320
503,246 A * 8/1893 McQuillen ..... 297/271.2
1,228,967 A * 6/1917 Rho ..... 297/20
1,440,329 A * 12/1922 Aime ..... 297/423.4
2,072,075 A 2/1937 Travers et al.
2,201,964 A 5/1940 Blank
2,213,590 A 9/1940 Parry
2,719,572 A 10/1955 Goldberg
2,777,505 A * 1/1957 Henrikson et al. ..... 297/423.16
2,964,097 A 12/1960 Moore
4,345,793 A * 8/1982 Duda ..... 297/423.4
4,487,345 A 12/1984 Pierce et al.
4,577,901 A 3/1986 Phillips
4,676,548 A 6/1987 Bradbury
4,767,160 A * 8/1988 Mengshoel et al. .... 297/423.12

(Continued)

FOREIGN PATENT DOCUMENTS

GB 1167887 10/1969

(Continued)

OTHER PUBLICATIONS

International Search Report and Written Opinion for PCT/US2006/026080 dated Nov. 16, 2006 (12 pages).

*Primary Examiner*—Peter R. Brown
(74) *Attorney, Agent, or Firm*—LaMorte & Associates

(57) ABSTRACT

An apparatus including an elongate post having a first end and a second end; a clamp coupled to the first end of the post, the clamp including a dimension suitable to couple to a seat frame of a chair; a leg support frame including a first portion pivotally coupled to the second end of the post and a second portion; and a leg support coupled to the second portion of the leg support frame. A method including coupling a leg support assembly to a chair, the leg support assembly including a leg support frame, wherein in a coupled configuration with a chair on a surface, coupling includes coupling such that a first portion of the leg support frame is in contact with the surface.

6 Claims, 8 Drawing Sheets

U.S. PATENT DOCUMENTS

| | | | | |
|---|---|---|---|---|
| 4,898,421 | A | | 2/1990 | Brunn |
| 5,251,956 | A | * | 10/1993 | Hofmeyer ..... 297/173 |
| 5,255,957 | A | * | 10/1993 | Opsvik et al. ..... 297/423.12 |
| 5,297,708 | A | | 3/1994 | Carpenter |
| 5,328,247 | A | | 7/1994 | Lovins |
| 5,409,291 | A | | 4/1995 | Lamb et al. |
| 5,413,400 | A | * | 5/1995 | Llanes ..... 297/154 |
| 5,464,270 | A | | 11/1995 | Chang |
| 5,527,088 | A | | 6/1996 | MacLean |
| 5,536,064 | A | | 7/1996 | MacLean |
| 5,538,318 | A | | 7/1996 | MacLean |
| 5,547,246 | A | | 8/1996 | Lambert |
| 5,588,696 | A | | 12/1996 | Jay et al. |
| 5,611,594 | A | | 3/1997 | Findlay |
| 5,628,437 | A | | 5/1997 | Kober |
| 6,056,172 | A | | 5/2000 | Welsh |
| 6,095,599 | A | | 8/2000 | Lambert |
| 6,354,657 | B1 | | 3/2002 | Nelson et al. |
| 6,547,324 | B1 | | 4/2003 | Ammann, Jr. |
| 6,572,185 | B1 | | 6/2003 | Tseng |
| 2003/0075967 | A1 | | 4/2003 | Ciolfe et al. |

FOREIGN PATENT DOCUMENTS

| | | |
|---|---|---|
| WO | WO 00/41590 | 7/2000 |
| WO | WO 01/54941 A1 | 8/2001 |

* cited by examiner

FOOTREST FOR CHAIR

CROSS-REFERENCE TO RELATED APPLICATION

This application claims the benefit of the earlier filing date of now abandoned U.S. Provisional Application No. 60/697,460, filed Jul. 8, 2005, and incorporated herein by reference.

BACKGROUND

1. Field

Chairs.

2. Description of Related Art

A folding chair is a popular household and recreation device because it provides seating accommodation and it can be folded or collapsed into a configuration that often may be stored more easily than in a configuration to accommodate a person within the chair. One conventional folding chair utilizes a U-shaped seat frame and a U-shaped back frame connected together at their leg ends. Panels of a cloth or canvas material, plastic (e.g., polyester vinyl) material (including plastic woven strips) cover at least a portion of the seat frame and the back frame to support a person seated within the seat frame and back frame. In one embodiment, the U-shaped seat frame may be rotated about an axis defined through the ends of the legs of the U-shaped back frame from a collapsed position e.g., with the base of the U-shaped seat frame against the U-shaped back frame) to a seating configuration with the base of the U-shaped seat frame extending away from the base of the U-shaped back frame at an angle of 90° or more.

In recent years, the convenience and utility arose for having a folding chair that can be carried around to different locations such as the beach, the park, and sporting events. U.S. Pat. No. 6,056,172 describes a folding chair made up of preferably lightweight U-shaped metal alloys or plastic with straps coupled to a panel to allow a user to wear the chair on his or her back. A pouch is also coupled to the same or another support panel to allow a user to carry or store articles in the pouch.

DETAILED DESCRIPTION

Figure 1:
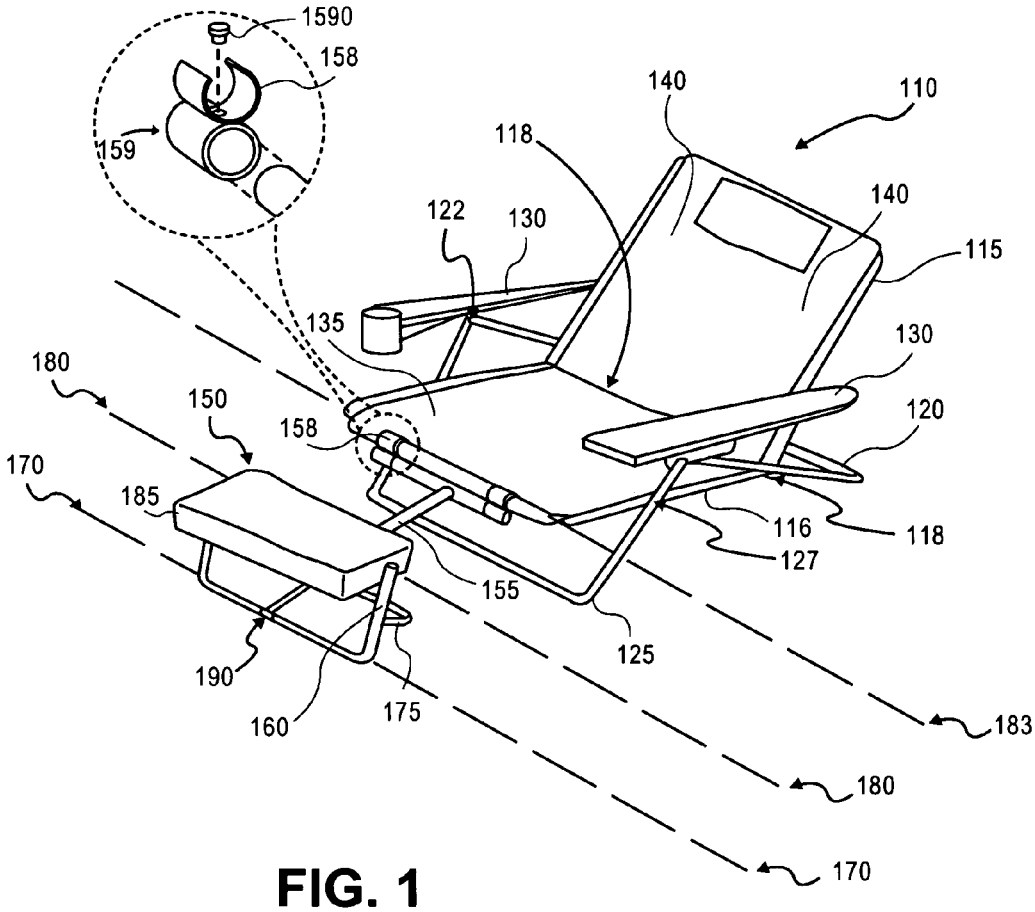
FIG. 1 shows a top right side perspective view of an embodiment of a folding chair having a footrest assembly with the footrest assembly in an extended position.

FIGS. 1-9 show an embodiment of a flat folding portable chair or a footrest assembly or portions of a footrest assembly associated with a portable chair. The chair may be a backpack unit such as described in U.S. Pat. No. 6,056,172. Other flat folding chairs, described as recreational use chairs, portable chairs, pool chairs, etc. are also contemplated. Other forms of portable chairs, such as collapsible chairs, are also contemplated. Non-folding chairs, such as stackable pool chairs, are further contemplated.

In the embodiment shown in association with FIGS. 1-9, folding chair 110 consists of a frame in the form of a folding chair. The frame is of a lightweight material including, but not limited to, metal alloy or plastic. Suitable metals or alloys include, but are not limited to, aluminum alloy, steel and steel alloy. The frame includes U-shaped seat frame 116 pivotally coupled at its ends to the ends of U-shaped back frame 115 through cross member 118. In this manner, U-shaped back frame is adapted to rotate about cross-member 118. Cross member 118 is, for example, a lightweight metal alloy rod that extends the width of U-shaped back frame 115 and is coupled to the ends of U-shaped back frame 115 and U-shaped seat frame 116. The frame also includes U-shaped front leg frame 125 connected at its ends to the ends of U-shaped back leg frame 120 through separate cross-members 122 to form a rotational axis. Cross-members 122 are, for example, cylindrical rivets, screws, bolts, or other suitable fasteners. Cross-members 122 are coupled at respective ends of U-shaped front leg frame 125 and U-shaped back leg frame 120. In one embodiment, each of back frame 115, seat frame 116, and back leg frame 120 have different widths and the width of front leg frame 125 and back frame 115 are substantially similar. In this manner, in a folded position or state, each of the components of the frame are substantially parallel and adjacent to one another with back leg frame 120 being widest, followed by back frame 115 and front leg frame 125, and seat frame 116.

In one embodiment, front leg frame 125 is rotatably coupled to seat frame 116 at point 127 substantially between the ends and the apex of front leg frame 125 and the ends and apex of seat frame 116. In one embodiment, concave-shaped rollers extend from each end of cross-member 118. Concave-shaped rollers are configured to abut back leg frame 120 when back frame 115 of the frame is in an unfolded state. In this manner, cross-member 118 supports back frame 115 by displacing a downward force onto back leg frame 120 to limit the rotation of back frame 115 about cross-member 118. Support members may be added to either side of the back leg frame 120 and coupled to cross-member 118 to further support back frame 115 when the frame is in an unfolded state.

Folding chair 110 also includes a pair of armrests 130 pivotally coupled at one end to back frame 115 and positionally coupled to the ends of back leg frame 120 and front leg frame 125. The armrests are made of a durable material that is comfortable to the exposed arms of a user seated in folding chair 110. Suitable material includes, but is not limited to, plastic and wood. In one embodiment, inferiorly extending plates are connected to the base of each armrest 130 and individually coupled to cross-members 122 between the outer back leg frame 120 and the inner front leg frame 125. These plates may have a number of laterally extending openings branching from a central opening through the plate at angles on the order of 30°-90°. These angle openings allow for the reclining of back frame 115 by adjusting the point where cross-members 122 connect armrest 130 to the ends of back leg frame 120 and front leg frame 125. Armrests 130 are rotatably coupled substantially about a midpoint between the apex and ends of back frame 115. The rotatable coupling allows armrests 130 to collapse and be rotated so that when the chair is in a folded state, armrests are substantially parallel to back frame 115. The movement of the armrests as well as a description of a frame of a folding chair is described in U.S. Pat. No. 6,056,172 which is incorporated herein by reference.

In addition to the frame of folding chair 110, the unit includes at least one panel to support a user seated within the frame. In one embodiment, the panel is made of a durable material such as canvas (e.g., 600 Denier canvas), polyester, or other cloth or cloth-like material. In one embodiment, the panel is coupled to the apex of back frame 115 and the apex of seat frame 116. The coupling may be accomplished by looping the panel material, for example, over the apex of back frame 115 and sewing the looped portion to the back side of the panel. A similar sewing procedure may be used to couple the panel to the apex of seat frame 116. In one embodiment, the panel is made up of seat panel 135 and back panel 140. Seat panel 135 is coupled, such as described above, to the apex of seat frame 116. Seat panel 135 is also coupled at its other end in a similar fashion to cross-member 118 and is coupled at a tension to support an average user of the frame as a chair. Back panel 140 is coupled, such as described above, to the apex of back frame 115 and is coupled at its other end to seat panel 135, such as for example, by sewing. Back panel 140 and seat panel 135 are coupled at a tension to support an average user of the frame as a chair.

Returning again to the frame of folding chair 110, one or more of U-shaped back frame 115, U-shaped seat frame 116, U-shaped back leg frame 120, and U-shaped front leg frame 125 may be a tubular structure having an opening or lumen there through, such as an aluminum tube. In one embodiment, seat frame 116 is a tubular structure. Coupled at a midpoint of the base of U-shaped seat frame 116 is footrest assembly 150.

Figure 2:
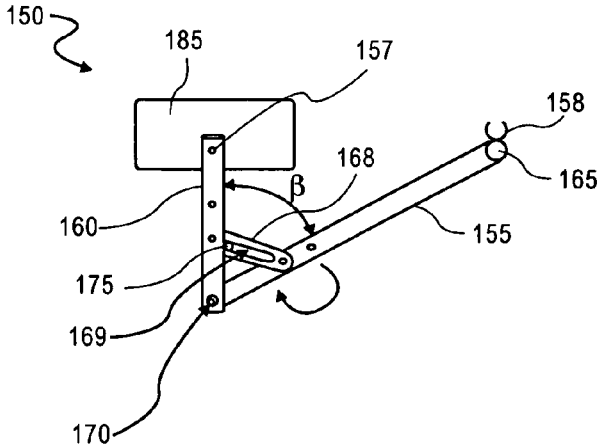
FIG. 2 shows a side view of the footrest assembly of FIG. 1.
Figure 3:
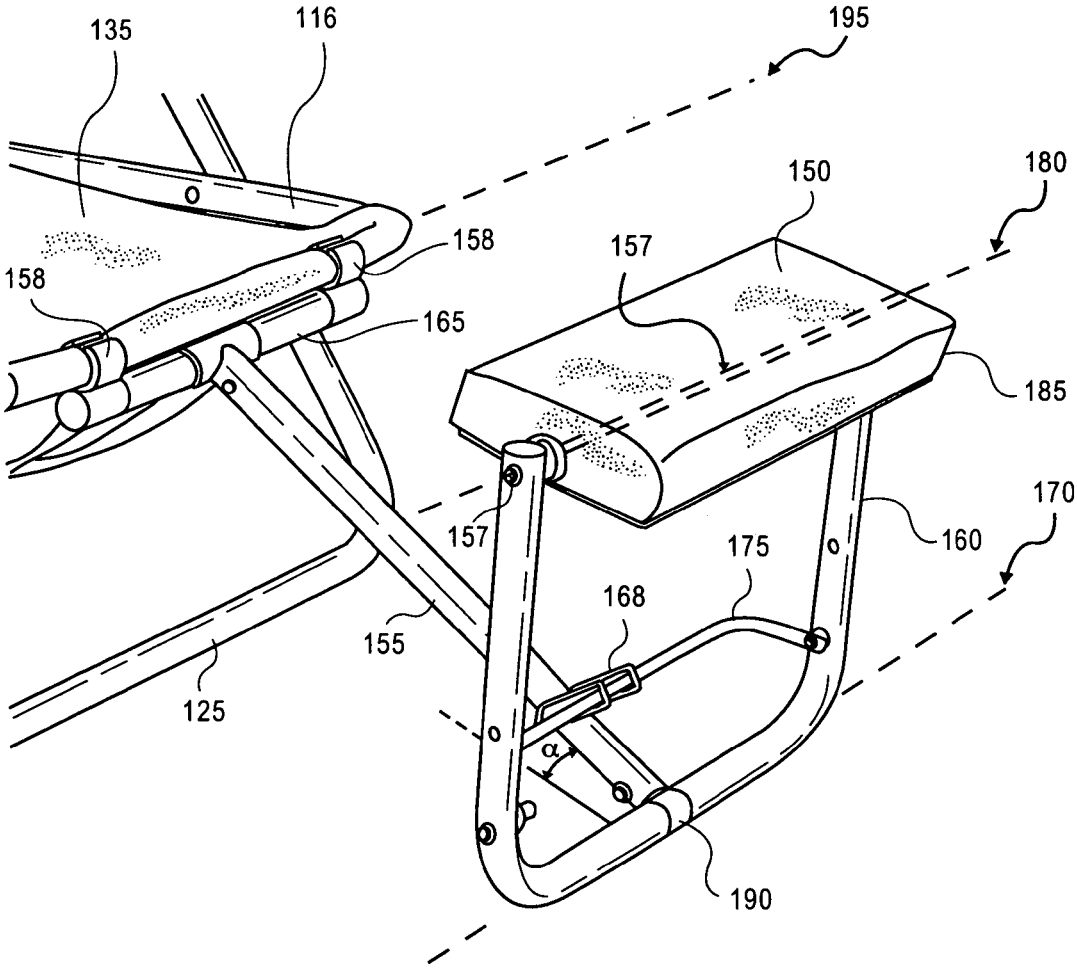
FIG. 3 shows a top left side perspective view of the folding chair of FIG. 1 having a footrest assembly in an extended position.
Figure 7:
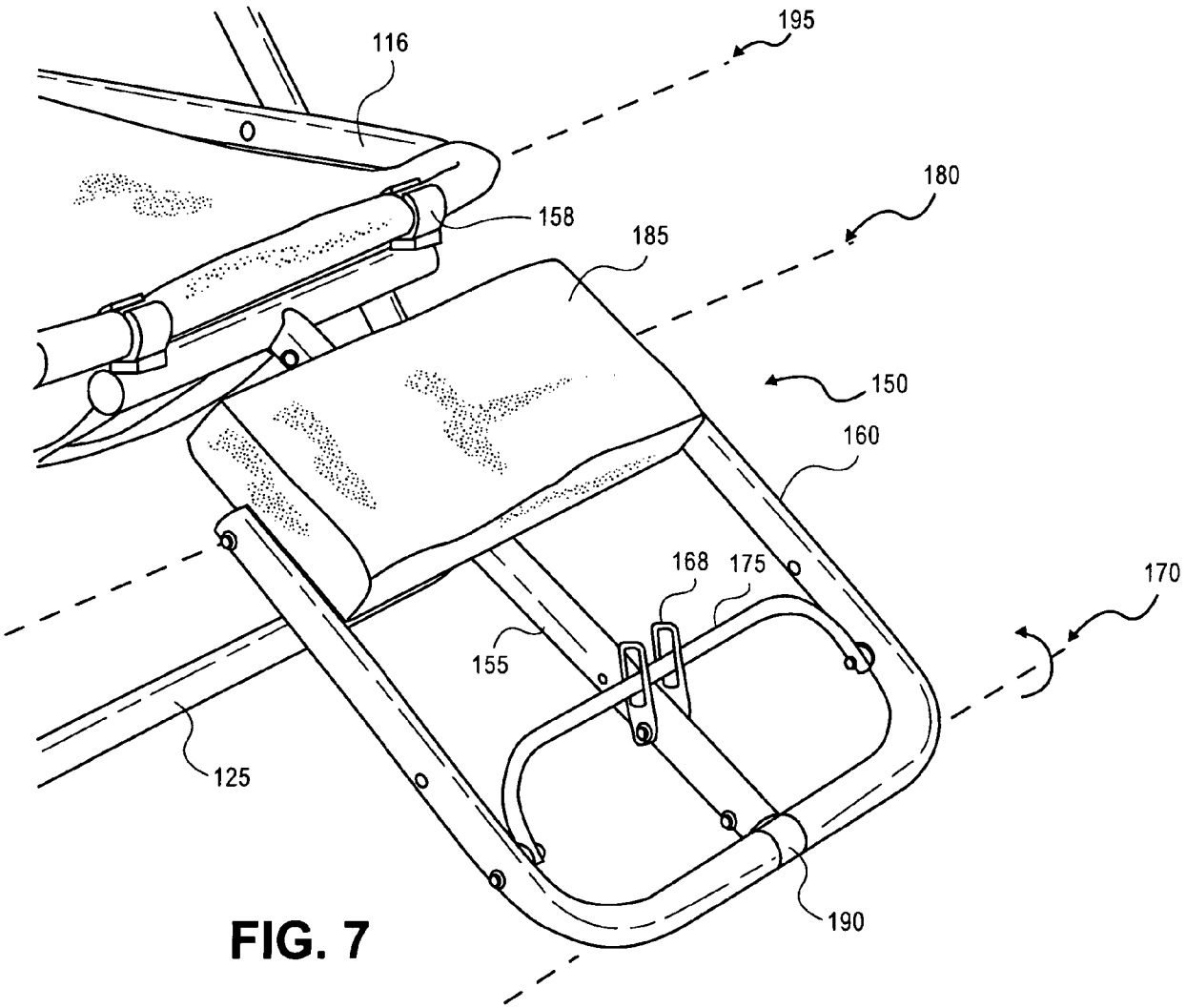
FIG. 7 shows the embodiment of the folding chair of FIG. 1 with the footrest assembly in a semi-retracted position.

FIG. 2 shows a side view of footrest assembly 150. FIG. 3 shows a left perspective view of footrest assembly 150. In this embodiment, footrest assembly 150 includes diagonal elongate post 155 connected at one end to a mid-point of upper lateral post 165 and at another end to a mid-point of a base of U-shaped member 160. Diagonal post 155, for example, is of a length greater than the distance between a surface (e.g., the ground) and seat frame 116 (with the chair positioned as shown in FIG. 1), so that in its extended position as shown in FIGS. 3 and 7, diagonal post 155 may form an approximate 20°-40° angle $\alpha$ with the surface. In one embodiment, the legs of U-shaped member 160 may have a length approximately equal to the distance between the surface and a base of seat frame 116, with the chair positioned as shown in FIG. 1. In one embodiment, a base of U-shaped member 160 may have a length slightly less than a width of a base of U-shaped seat frame 116. Diagonal post 155, U-shaped member 160 and upper lateral post 165 are each, for example, aluminum alloy tubular structures (e.g., 25 mm tubes).

Referring to FIG. 1 and FIG. 3, upper lateral post 165 of footrest assembly 150 has a length that extends, in one embodiment, less than a width of a base of U-shaped seat frame 116 and slightly less than a width of a base of U-shaped member 160. In one embodiment, upper lateral post 165 is a multi-component structure defined in more detail in a subsequent paragraph with reference to FIG. 4. In another embodiment, upper lateral post 165 is a single structure connected at its midpoint to diagonal post 155, such as by a weld or a screw through upper lateral post 165 into a nut or similar female fastener disposed in diagonal post 155.

At end portions of upper lateral post 165 are clamps 158 (two), each having a dimension (e.g., a diameter) equivalent or slightly greater than an outer diameter of a base of U-shaped seat member 116. Each clamp 158 is adapted to clamp to U-shaped seat member 116 and fasten footrest assembly 150 to chair 110. In an example where a base of U-shaped seat member 116 is tubular, clamps 158 have a base and leg portions of a tubular shape with an interior diameter slightly larger than an exterior diameter of a base of U-shaped seat member 116. In one embodiment, clamps 158 are made of a plastic material and have leg portions that can flex to expand the ends of the leg portions around a base of U-shaped seat member 116. Footrest assembly 150 may be clamped to folding chairs 110 by forcing clamps 158 on/around a base of U-shaped seat member 116 (a pushing force toward a base of U-shaped seat member 116). Footrest assembly 150 may be separated from folding chair 110 by separating clamps 158 from a base of U-shaped seat member 116 (a pulling force away from a base of U-shaped seat member 116). In one embodiment, where a panel material, such as a material for seat panel 135, extends around a base of seat frame 116, openings may be made in panel 135 to expose portions of a base of seat frame 116.

In one embodiment, a base of each clamp 158 includes tubular stopper 159 with an open end and a closed end and a length between the open and closed ends extending the width of clamp 158. Stopper 159 has a interior diameter slightly larger than an exterior diameter of lateral post 165 so that stopper 159 can be placed over an end of lateral post 165 to cap lateral post 165. In one embodiment, stopper 159 is connected to lateral post by screw 1590 inserted through a base of clamp 158.

As noted above, in one embodiment, clamps 158 have a tubular shape similar to a shape of seat frame 116. The tubular shape connects upper lateral post 165 of footrest assembly 150 to seat frame 116 and may allow footrest assembly 150 to swivel about seat frame 116 (defining axis 183 (FIG. 1)) to, for example, place footrest assembly 150 on seat panel 135 (e.g., when chair 110 is in a non-use configuration (see FIG. 5)).

As described above, clamps 158 are used to connect footrest assembly 150 to chair 110. In this embodiment, footrest assembly 150 is detachable from chair 110. In another embodiment, the clamps may be circular and completely surround the base of U-shaped seat member 116. A diameter of a circular clamp may be slightly greater than a diameter of a base of U-shaped seat frames so that footrest assembly may still swivel about the clamps (rotate about axis 183).

Figure 4:
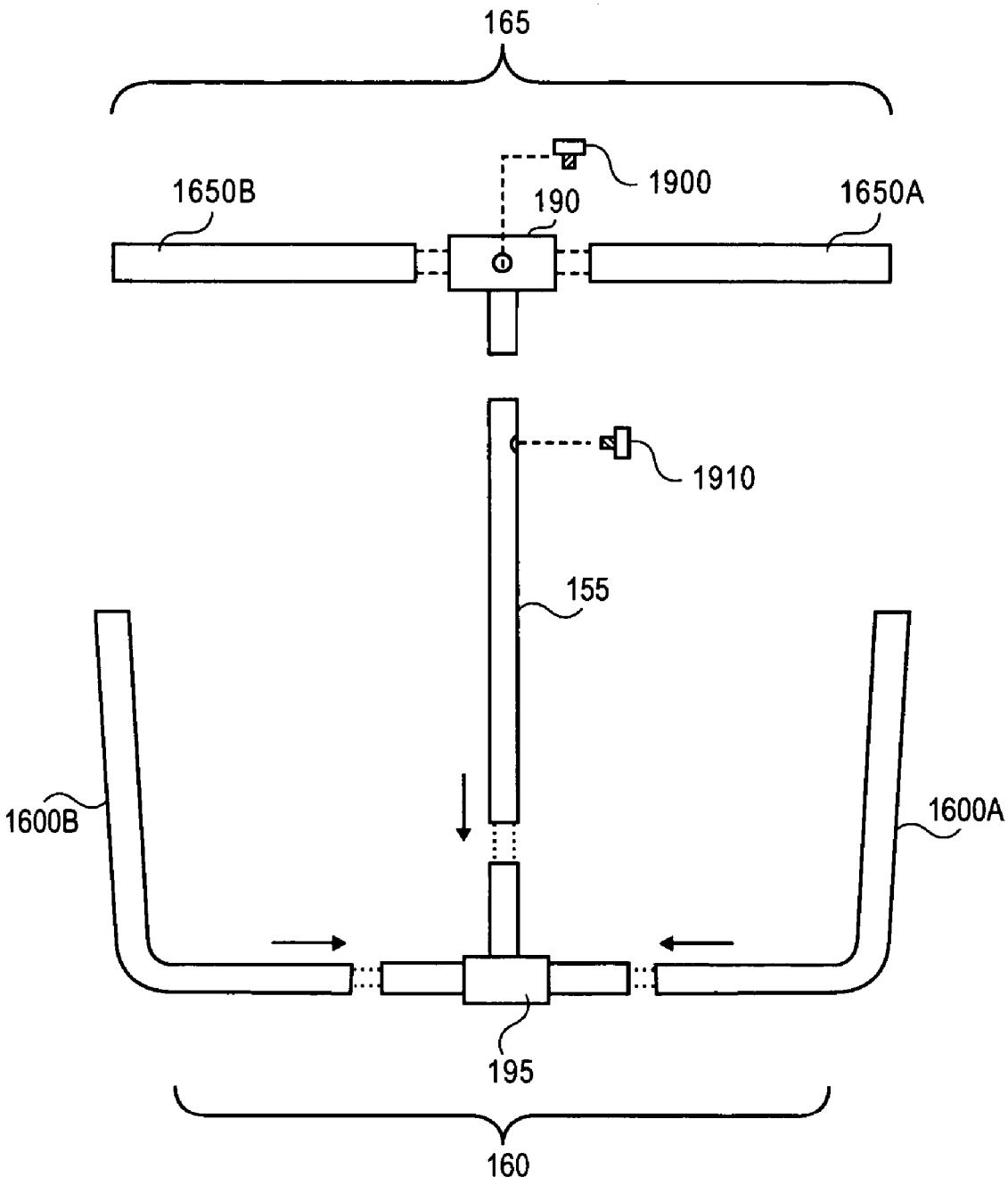
FIG. 4 shows a disassembled view of an embodiment of a cushion of a footrest assembly.

FIG. 4 shows one embodiment of upper lateral post 165 of footrest assembly 150 and its connection to diagonal post 155. In this embodiment, diagonal post 155 is connected to upper lateral post 165 through sleeve insert 190 and upper lateral post 165 is made up of two equal length portion 1650A and portion 1650B. Sleeve insert 190 is, for example, a T-shaped insert made from, for example, a rigid plastic material (e.g., acrylonitrile butadiene styrene (ABS)), with a lateral portion of the T having openings on opposite ends (openings optionally define through the lateral portion) of an inner diameter of each length portion (length portion 1650A and length portion 1650B) slightly larger than a diameter of portion 1650A and portion 1650B, respectively. The lateral portion of the T of insert 190 has a length suitable to accommodate an end portion of each of portion 1650A and portion 1650B. In this manner, the lateral portion of insert 190 supports portion 1650A and portion 1650B to define upper lateral post 165. A midpoint of the lateral portion of insert 190 may have an opening into the openings in portion 1650A and portion 1650B to accommodate fastener 1900 such as a screw that may secure each of portion 1650A and portion 1650B to insert 190 by, for example, friction.

A vertical portion of the T of sleeve insert 190 has an exterior diameter less than an interior diameter of diagonal post 155. The vertical portion of insert 190 may be inserted into diagonal post 155 to connect diagonal post 155 to upper lateral post 165. Diagonal post 155 may be secured to the vertical portion of insert 190, in one embodiment, by fastener 1910 such as a screw that may extend through a side of diagonal post 155, through the vertical portion of insert 190 and through an opposite side of diagonal post 155.

FIG. 4 also shows one embodiment of U-shaped member 160 of footrest assembly 150 and its connection to diagonal post 155. In this embodiment, diagonal post 155 is connected to a base of U-shaped member 160 through sleeve insert 195. Sleeve insert 195 is, for example, a T-shaped insert made from, for example, a rigid plastic material (e.g., acrylonitrile butadiene styrene (ABS)), with a lateral portion of the T including a central portion and, in one embodiment, oppositely extending finger portions of an exterior diameter smaller than the central portion. Each finger portion is, for example, a cylindrical body having an exterior diameter less than an interior diameter of a base of U-shaped member 160. A vertical portion of the T sleeve insert 195 in the body of a tubular shaped diagonal post 155 is a cylindrical portion having an exterior diameter less than an interior diameter of diagonal post 155. U-shaped member 160 is made up of two pieces (opposing L-shaped piece 1600A and L-shaped piece 1600B) connected by sleeve insert 195. Opposite respective ends of the lateral portion of the T of sleeve insert 195 are inserted into a base end of each of L-shaped piece 1600A and L-shaped piece 1600B that make up U-shaped member 160. The vertical portion of the T of sleeve insert 195 is inserted into an end of diagonal post 155. The vertical portion of the T of sleeve insert 195 may be fixed to diagonal post with, for example, a screw or other fastener. In one embodiment, respective ends of the lateral portion of sleeve insert 195 are force fit into a base end of L-shaped piece 1600A and L-shaped base 1600B. In this manner, a base of U-shaped member 160 may rotate about diagonal post 155 (about axis 170).

Referring to FIGS. 1-3, cushion 185 of footrest assembly 150 is connected to axle 157 that extends between the ends of legs of U-shaped member 160. Axle 157 is, for example, a ⅜ inch aluminum rod that may extend through each of the legs of U-shaped member 160 and be connected to U-shaped member 160 by a clamp (e.g., a C clamp or other fastener). In one embodiment, cushion 185 and optionally axle 157 may be rotated about axis 180 (see FIG. 1 and FIG. 3). As shown in FIG. 1 and FIG. 3, cushion 185 may be positioned (by rotating cushion 185 and optionally axle 157 about axis 180) so that a length and width dimension of cushion 185 are parallel to the surface on which the chair is supported.

Figure 5:
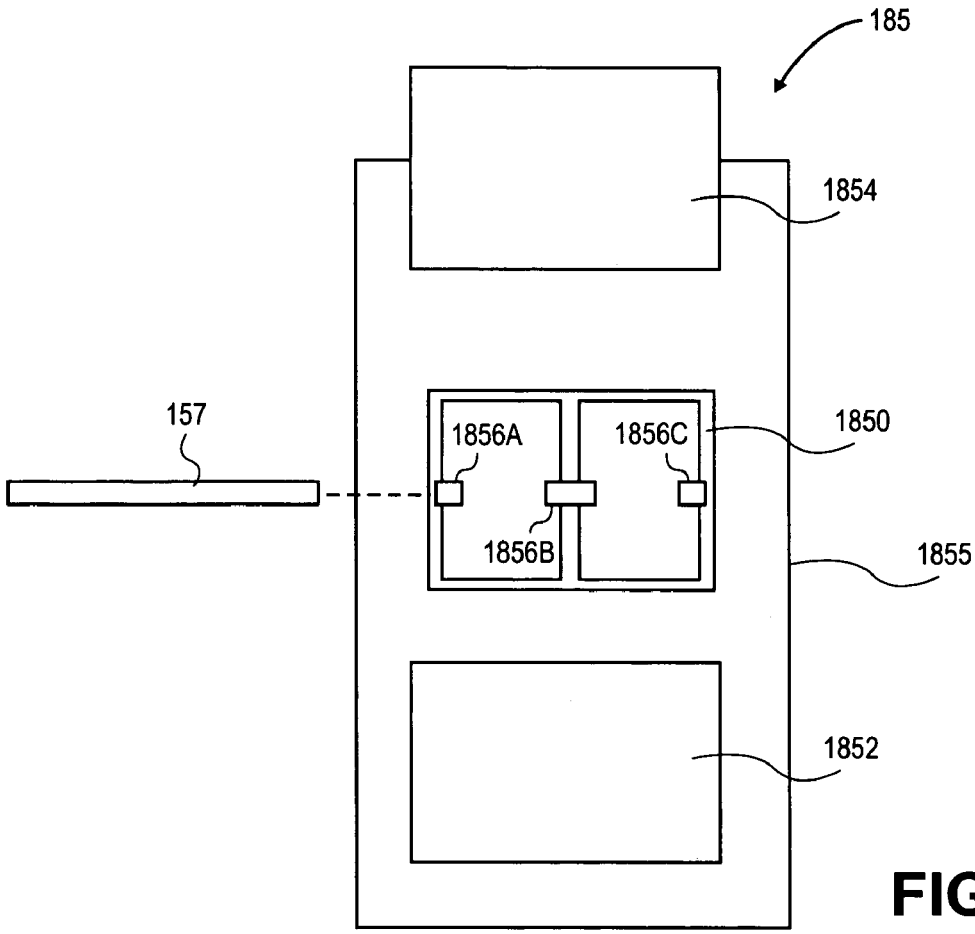
FIG. 5 shows an exploded side view of an embodiment of a cushion of a footrest assembly.
Figure 6:
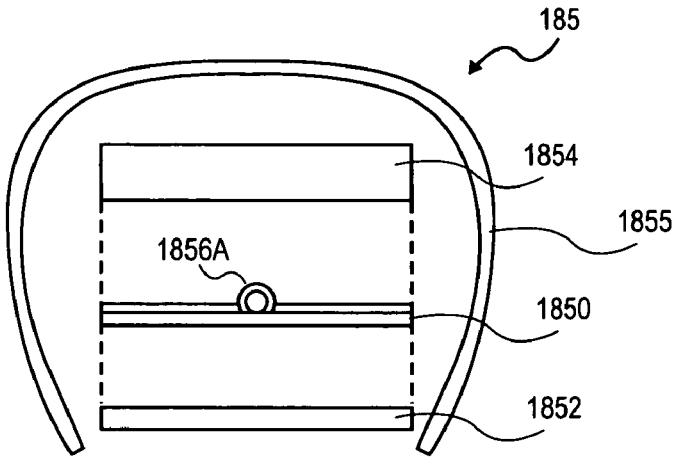
FIG. 6 shows an exploded embodiment of a connection of a diagonal post and a U-member shaped of an embodiment of a footrest assembly.

FIG. 5 shows an unassembled view of an embodiment of cushion 185. FIG. 6 shows an exploded side view of cushion 185. In this embodiment, cushion 185 includes receiving base 1850 disposed between backing 1852 and soft body 1854. In this embodiment, receiving base 1850 is rectangular sheet including a frame connected around an exterior edge of one side of the sheet. The frame includes a cross-member. The sheet and frame are made of a rigid material such as plastic (e.g., polyethylene). A representative dimension of the sheet of receiving base 1850 of polyethylene is seven inches by 11.75 inches by 0.125 inches. Connected at the ends of the frame and at a midpoint of the cross-member of receiving structure 1850 are coaxially-aligned sleeves 1856A, 1856C, and 1856B, respectively, of tubular configuration and each having an interior diameter suitable to accept axle 157 therethrough.

In the embodiment shown in FIG. 5, backing 1852 is a rectangular sheet of a rigid material of plastic such as polyethylene (e.g., 0.125 inches thick sheet having length and width dimensions similar to receiving base 1850. Soft body 1854 is a cushiony, flexible and/or malleable material. One example is a foam made of a blend of resins having a cellular structure (e.g., via a blowing agent). The length and width dimensions of soft body 1854 may be similar to the length and width dimensions of receiving base 1850.

Soft body 1854, receiving base 1850, and backing 1852 may be sandwiched together by contacting a bottom surface of soft body 1854 with a top surface of receiving base 1850 and a bottom surface of receiving base 1850 with a top surface of backing 1852. Overlying the sandwiched structure of soft body 1854, receiving base 1850, and backing 1852 is material 1855. In one embodiment, material 1855 is a material similar to a material that might be used for a panel of chair 110, such as canvas, polyester, or other cloth or cloth-like material. Representatively, material 1855 may have length and width dimensions suitable to surround and cover soft body 1854 and receiving base 1850 and partially surround a bottom surface of backing 1852. In this manner, material 1855 may be glued to an exposed surface of backing 1852 with a suitable adhesive. Alternative connection mechanisms may be substituted for an adhesive such as tacking or stapling material 1854 to bottom surface of backing 1852. Finally, material 1855 may include openings disposed on opposite side portions of the sandwiched structure corresponding to locations of sleeves 1856A and 1856B, so that axle 157 may be inserted through material 1855 on a first side portion of the sandwiched structure, into receiving base (through sleeves 1856A, 1856B, and 1856C) and through material 1855 on a second side portion of the sandwiched structure.

Footrest assembly 150 also includes lower lateral cross-bar 175 extending between the legs of U-shaped member 160. As viewed in FIG. 1 and FIG. 3, lower lateral cross-bar 175 has a U-shaped body with ends of each leg portion connected by, for example, a fastener to legs of U-shaped member 160. A connection may be such that lower lateral cross-bar 175 may be rotated about an axis defined by a projection through each of the connection points to U-shaped member 160. In one embodiment, the position of lower lateral cross-bar 175, relative to a surface (e.g., the ground), is disposed above an end of diagonal post 155. FIG. 2 and FIG. 3 show sleeve 168 connected at one portion to diagonal post 155; a base of lower lateral post 175 extends through lateral opening 169 in a second portion of sleeve 168. Lateral opening 169 allows U-shaped member 160 to pivot or move toward diagonal post 155. Sleeve 168 in addition to allowing U-shaped member 160 to pivot or rotate toward diagonal post 155, in conjunction with lateral cross-bar 175 also limits the rotation in the opposite direction, i.e., away from diagonal post 155. In the embodiment shown, there are two sleeves 168, one on each side of diagonal post 155. Representatively, in one embodiment, sleeves 168 and lateral cross-bar 175 limit the rotation of U-shaped member 160 away from diagonal post 155 to an angle, β, less than 90° from an axis defined by diagonal post 155 (see, e.g. FIG. 2).

Representative specifications for selected components of an embodiment of a footrest assembly that can be used with folding chair 110 having a base of U-shaped seat frame 116 approximately 10 inches above a surface (e.g., the ground) when folding chair 110 is in an open (expanded) configuration supported by the surface include:

| | |
|---|---|
| post 155 | 15-16 inches |
| U-shaped member 160 | |
| Legs (portion 1600A/1600B) | 12 inches |
| Base (including insert 195) | 13-14 inches |
| axle 157 | 14-15 inches |
| lateral post 165 (including portion 1650A, portion 1650B and insert 190) | 10 inches |

FIG. 7 shows folding chair 110 where footrest assembly 150 is semi-retracted by rotating U-shaped member 160 about axis 170 toward diagonal post 155. In this view, cushion 185 rotates about axis 180 so that a base of cushion 185 rests and/or is parallel to a length direction of diagonal post 155. In the semi-retracted position shown in FIG. 7, footrest assembly may be used as a calf-rest, to rest and/or support the calves of a user of the chair.

Figure 9:
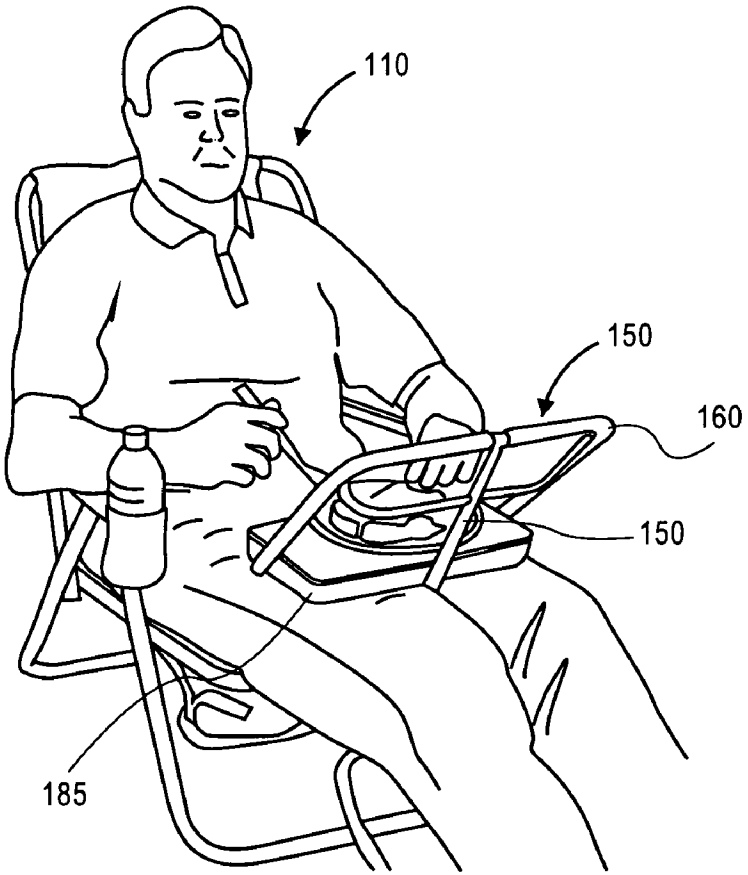
FIG. 9 shows the embodiment of the folding chair of FIG. 1 with the footrest assembly in a semi-retracted position with the footrest assembly functioning as a tray.
Figure 8:
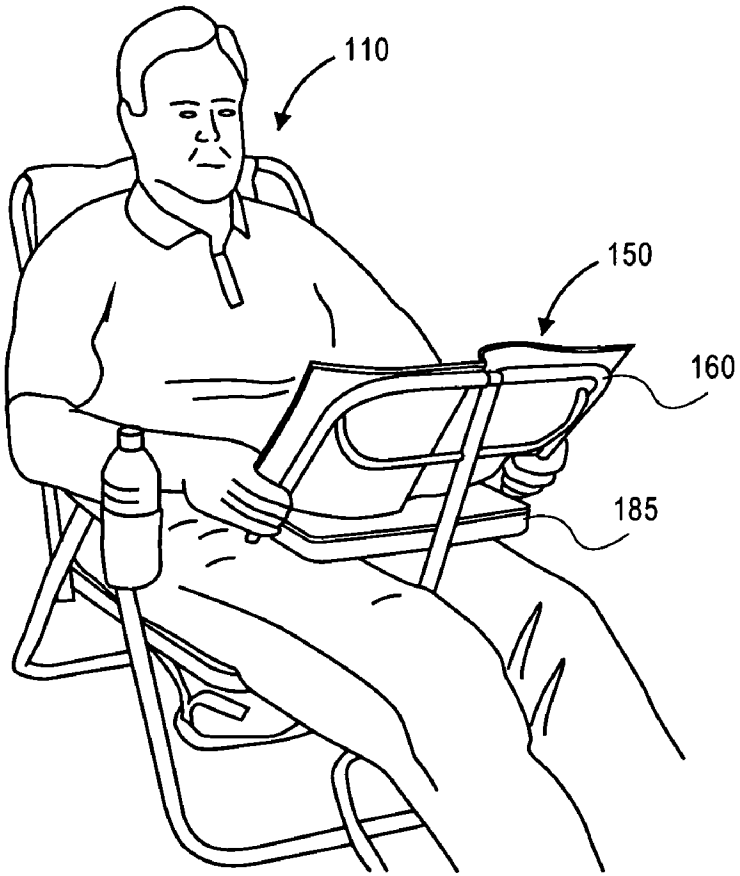
FIG. 8 shows the embodiment of the folding chair of FIG. 1 with the footrest assembly in a semi-retracted position with the footrest assembly functioning similar to an easel.

FIG. 8 shows folding chair 110 where footrest assembly 150 is retracted by rotating U-shaped member 160 about axis 170 (toward diagonal post 155) and diagonal post 155 about axis 183 (counterclockwise toward folding chair 110) so that, with the chair in an unfolded state, diagonal post 155 projects above U-shaped seat frame 116 (as viewed). A user, such as an adult human, may be seated in folding chair 110 with diagonal post 155 between the legs of the user. In one embodiment, cushion 185 may be rotated about axis 180 so that cushion 185 is substantially parallel to the legs (e.g., thighs) of the user (e.g., cushion 185 is rotated so that soft body 1854 (see FIG. 5) is adjacent the legs of the user). In this manner, U-shaped member 160 and cushion 185 may function similar to an easel to support a book or magazine. FIG. 9 shows another embodiment, where in the retracted position described with respect to FIG. 8, cushion 155 is used as a tray.

Figure 10:
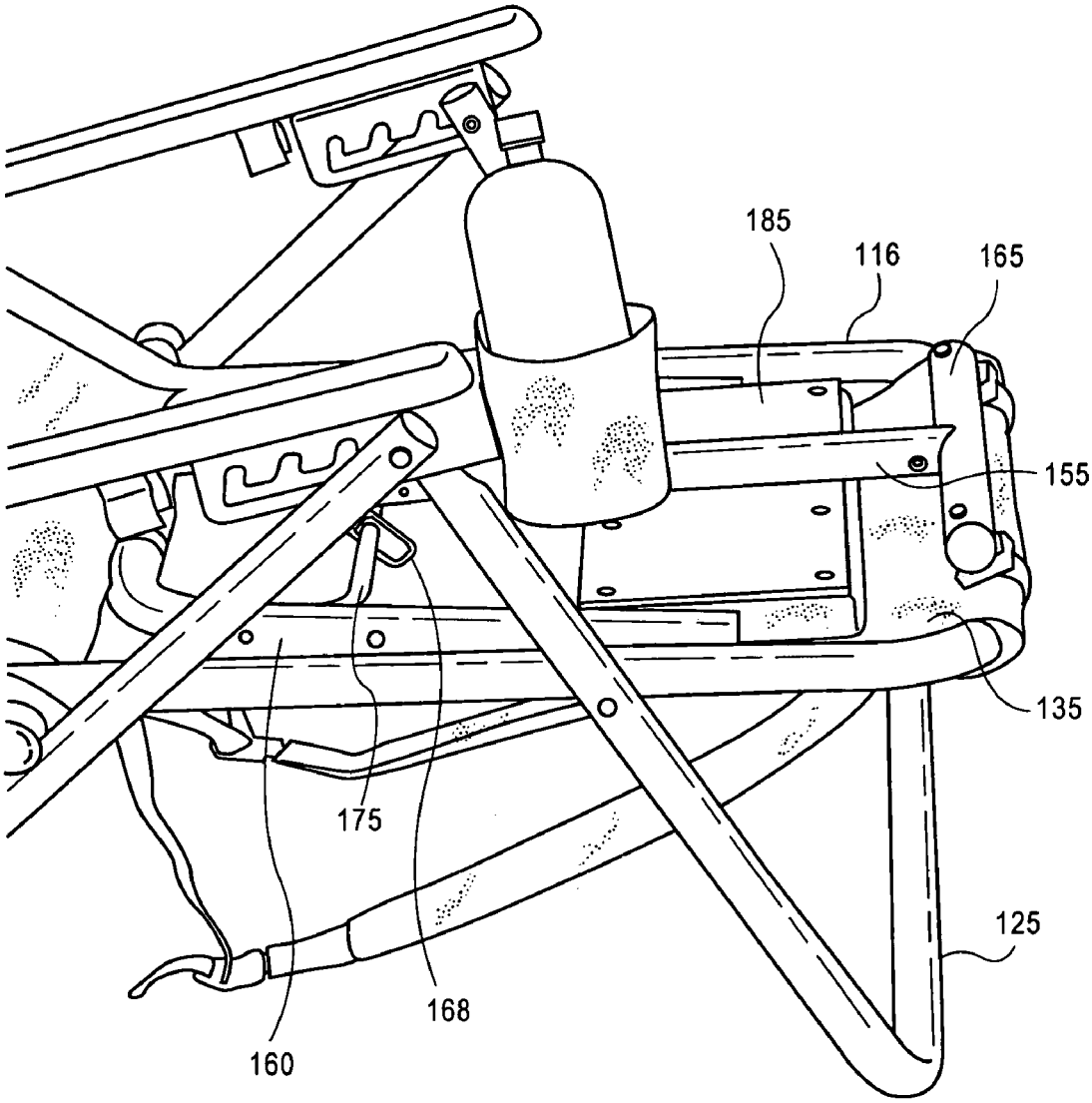
FIG. 10 shows the embodiment of the folding chair of FIG. 1 with the footrest assembly in a fully-retracted position.

FIG. 10 shows folding chair 110 with footrest assembly 150 in a fully retracted position. From the position shown in FIG. 7, for example, footrest assembly is rotated about axis 195 (defined by the connection of clamps 158 to a base U-shaped seat member 116). In the fully retracted position, cushion 185, diagonal post 155, upper lateral post 165 and lower lateral post 175 are all disposed above seat panel 135, with a face of cushion 185 adjacent a base of seat frame 116 and a base of U-shaped member 160 adjacent cross-member 118 of fold up chair 110.

Figure 11:
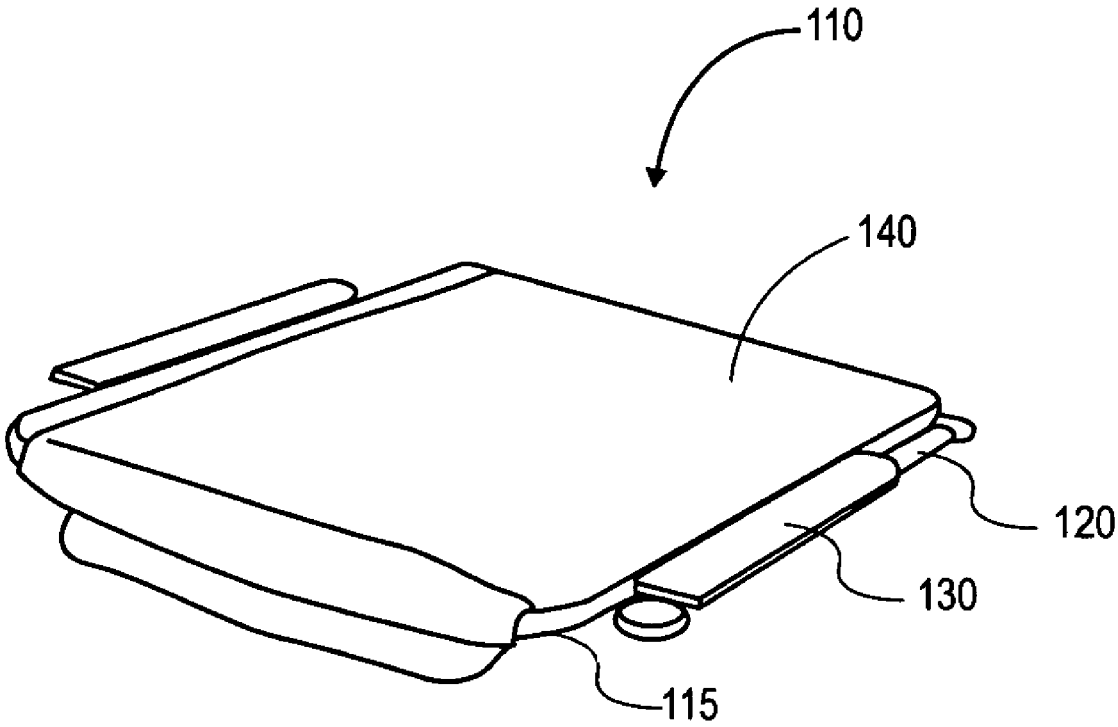
FIG. 11 shows the embodiment of the folding chair of FIG. 1 in a folded or collapsed position.

FIG. 11 shows folding chair 110 in a collapsed configuration. In one embodiment, footrest assembly 150 is retracted into seat panel 135 and then back panel 140 is moved towards seat panel 135 so that footrest assembly 150 is sandwiched between seat panel 135 and back panel 140.

In the preceding detailed description, specific embodiments are described. It will, however, be evident that various modifications and changes may be made thereto without departing from the broader spirit and scope of the claims. The specification and drawings are, accordingly, to be regarded in an illustrative rather than a restrictive sense.

What is claimed is:

1. An apparatus comprising:

an elongate post having a first end and a second end;

a clamp coupled to the first end of the post, the clamp comprising a dimension suitable to couple to a seat frame of a chair;

a leg support frame comprising a first portion coupled to the second end of the post and a second portion; and a leg support coupled to the second portion of the leg support frame, wherein in a configuration with a chair on a surface, the clamp may be coupled to a seat frame of a chair and the first portion of the leg support frame is in contact with the surface projecting the leg support away from the surface, wherein the U-shaped structure of the leg support frame comprises two directionally opposed L-shaped members connected by a lateral portion of a T-shaped sleeve insert, and the elongate post is connected to the base of the U-shaped structure by a longitudinal portion of the above insert.

2. The apparatus of claim 1, further comprising: a lateral U-shaped cross-bar comprising legs extending between the legs of the U-shaped structure and a base; and a link comprising a first end and a second end, the first end coupled to the post and coupled to respective ones of the second end defining an opening, and the base of the cross-bar extends through the opening.

3. The apparatus comprising:

an elongated post having a first end and a second end;

a first clamp coupled to the first end of the post, the clamp comprising a dimension suitable to couple to a seat frame of a chair;

a leg support frame comprising a first portion coupled to second end of the post and a second portion;

a leg support coupled to the second portion of the leg support frame;

a seat attachment segment, coupled at a midsection to the first end of the post; and a second clamp, wherein in a configuration with a chair on a surface, the clamp may be coupled to a seat frame of a chair and the first portion of the leg support frame is in contact with the surface projection the leg support away from the surface, wherein the first clamp is coupled to the seat attachment segment at a point between a first end and the midsection, and wherein the second clamp is coupled to the seat attachment segment at a point between a second end and the midsection.

4. A method comprising:

coupling a leg support assembly to a chair, the leg support assembly comprising:

an elongate post having a first end and a second end;

a clamp coupled to the first end of the post, the clamp comprising a dimension suitable to detachably couple to a seat frame of the chair;

a leg support frame comprising a first portion pivotally coupled to the second end of the post and a second portion;

a leg support coupled to the second portion of the leg support frame, wherein in a coupled configuration with a chair on a surface, coupling comprises coupling the clamp of the leg support assembly to the chair such that the first portion of the leg support frame is in contact with the surface and the post has a length that extends diagonally between the seat frame and the first portion of the leg support frame.

5. The method of claim 4, further comprising:

positioning the footrest assembly so that the leg support of the footrest assembly is positioned a distance from the surface such that a leg of a person seated in the chair may be supported by the leg support above the surface.

6. The method comprising:

coupling a leg support assembly to a chair, the leg support assembly comprising;

an elongate post having a first end and a second end;

a clamp coupled to the first end of the post, the clamp comprising a dimension suitable to detachably couple to a seat frame of the chair;

a leg support frame comprising a first portion pivotally coupled to the second end of the post and second portion;

a leg support coupled to the second portion of the leg support frame, wherein in a coupled first configuration with a chair on a surface, the first portion of the leg support frame is in contact with the surface, wherein in a coupled second configuration, the post, the leg support frame and the leg support lie flat on a seat of the chair.

* * * * *